US007202435B2

(12) United States Patent
Claessens et al.

(10) Patent No.: US 7,202,435 B2
(45) Date of Patent: Apr. 10, 2007

(54) CIRCUIT-BREAKER

(75) Inventors: Max Claessens, Gebenstorf (CH); Stephan Grob, Baden (CH); Xiangyang Ye, Künten (CH)

(73) Assignee: ABB Schweiz AG, Baden (CH)

( * ) Notice: Subject to any disclaimer, the term of this patent is extended or adjusted under 35 U.S.C. 154(b) by 3 days.

(21) Appl. No.: 11/062,556

(22) Filed: Feb. 23, 2005

(65) Prior Publication Data

US 2005/0146406 A1 Jul. 7, 2005

Related U.S. Application Data

(63) Continuation of application No. 10/660,532, filed on Sep. 12, 2003, now Pat. No. 6,872,907.

(30) Foreign Application Priority Data

Sep. 24, 2002 (EP) ..... 02405825

(51) Int. Cl.
*H01H 33/53* (2006.01)

(52) U.S. Cl. ..... 218/66; 218/43; 218/46; 218/47; 218/51; 218/52

(58) Field of Classification Search ..... 218/43–52, 218/66
See application file for complete search history.

(56) References Cited

U.S. PATENT DOCUMENTS 4,239,949 A 12/1980 Kii et al.
4,471,188 A 9/1984 Van et al.
5,231,256 A 7/1993 Yamagiwa et al.
5,717,183 A 2/1998 Lehmann et al.
5,977,502 A 11/1999 Mizoguchi et al.
6,207,917 B1 * 3/2001 Lehmann et al. ..... 218/43
6,472,629 B2 10/2002 Dufournet
6,730,871 B1 5/2004 Loebner
6,872,907 B2 3/2005 Claessens et al.

FOREIGN PATENT DOCUMENTS

DE 1889068 12/1967
EP 0836209 4/1998
EP 0933795 8/1999

* cited by examiner

*Primary Examiner*—Ramon M. Barrera
(74) *Attorney, Agent, or Firm*—Buchanan Ingersoll & Rooney PC

(57) ABSTRACT

An exemplary circuit breaker includes at least one arcing chamber that is filled with isolating gas, extends along a longitudinal axis, is designed to be essentially radially symmetrical, contains an arc area and has at least two power contact pieces. At least one of the power contact pieces is in the form of a moving or stationery tubular hollow contact, which is provided for dissipating hot gases from the arc area into a concentrically arranged exhaust body. A deflection device, which interacts with at least one opening in the hollow contact, is arranged on the side of the hollow contact facing away from the arc area, and radially deflects hot gases into the exhaust volume, which is connected through at least one second opening to an arcing chamber volume. An increased disconnection rating is achieved by providing at least one intermediate body between the hollow contact and the exhaust body.

26 Claims, 5 Drawing Sheets

CIRCUIT-BREAKER

RELATED APPLICATIONS

This application is a continuation of U.S. application Ser. No. 10,660,532 filed in the U.S. Patent and Trademark Office on 12 Sep. 2003 now U.S. Pat. No. 6,872,907, which claims priority from European Patent Application EP 02405825.7 filed 24 Sep. 2002. U.S. application Ser. No. 10,660,532 is hereby incorporated by reference in its entirety.

BACKGROUND OF THE INVENTION

The document EP 0 836 209 A2 discloses a circuit-breaker which can be used in an electrical high-voltage network. This circuit-breaker has a rotationally symmetrical arcing chamber which is filled with an electrically negative gas, for example with $SF_6$ gas, as the quenching and isolating medium. In the connected state, a switching pin bridges the distance between the two main contacts of the arcing chamber, which in this type of switch are at a fixed distance from one another. During disconnection, the switching pin is moved axially in one direction, and the two main contacts are moved jointly in the opposite direction. The switching pin then strikes an arc between the two main contacts, which burns until it is quenched in an arc area that is located between the main contacts.

The hot and ionized gases which are produced in the arc area are dissipated, with some of them being stored in a hot volume and being used later in a known manner to assist the quenching process. The remaining hot gases are dissipated axially on both sides through the tubular main contacts into an exhaust volume. These axial gas flows which are carried in the tubular channels generally dissipate the majority of the hot gases, which are contaminated with conductive switching residues, out of the arc area so that no charge carriers are present after the arc has been quenched, which could assist restriking of the arc between the main contacts. In order to ensure an effective flow, the tubular channels are designed to assist the flow as far as possible. Furthermore, this avoids any excessively high backpressure from the exhaust volume having a reaction back into the arc area, with a negative influence on the quenching process. This circuit-breaker has a comparatively high disconnection rating.

SUMMARY OF THE INVENTION

Exemplary embodiments of the invention provide a circuit-breaker with a considerably greater disconnection rating, and which can be produced at low cost, using simple means.

A circuit-breaker in accordance with an exemplary embodiment of the invention has at least one arcing chamber, which is filled with an isolating gas, extends along a longitudinal axis, is radially symmetrical, contains an arc area and has at least two power contact pieces. At least one of the power contact pieces is in the form of a tubular hollow contact, which is provided for dissipating hot gases out of the arc area into an exhaust volume, having a deflection device, which is arranged on the side of the hollow contact facing away from the arc area, interacts with at least one first opening in the hollow contact and is connected to a connecting piece, for the radial deflection of the hot gases into the exhaust volume, which is connected through at least one second opening to an arcing chamber volume.

At least one intermediate volume is provided between the hollow contact and the exhaust volume. The at least one first intermediate volume is bounded from the exhaust volume by a first wall, with the first wall having at least one third, radially aligned opening, which connects the intermediate volume to the exhaust volume. This first wall is composed of a highly thermally conductive material, in particular of a metal. However, a plastic would be particularly advantageous at this point, which, in addition to having good thermally conductive characteristics, would have the characteristic of vaporizing slightly in the presence of the hot gases, thus extracting thermal energy from the gases. A further advantage would be achieved if the vaporizing plastic were to contain dissociating and/or electrically negative gases.

One particularly powerful embodiment variant of the circuit-breaker is obtained by complying with the following ratios:

$$V_1/A_1=(0.1 \text{ to } 0.5)\text{m},$$

$$V_2/A_2=(0.1 \text{ to } 0.5)\text{m},$$

$$V_3/A_3=(1.0 \text{ to } 2.5)\text{m},$$

where: $V_1$ is the volume within the hollow contact and $A_1$ is the cross section of the first opening, $V_2$ is the volume of the first intermediate volume and $A_2$ is the cross section of the third opening, $V_3$ is the volume of the exhaust volume and $A_3$ is the cross section of the second opening.

Another embodiment of the circuit-breaker has at least one second intermediate volume, which is referred to as an additional volume, between the first intermediate volume and the exhaust volume. This at least one additional volume is bounded from the exhaust volume by a second wall, with the second wall having at least one fourth, radially aligned opening, which connects the additional volume to the exhaust volume. The second wall is composed of a highly thermally conductive material, in particular of a metal or a plastic, as described in conjunction with the first wall.

The advantages achieved by the invention are that the particularly good cooling of the hot gases ensures that their volume is reduced progressively and hence that the hot gases flow in an optimum manner out of the arc area, so that a considerably higher disconnection rating is achieved with an arcing chamber having the same dimensions.

The invention, its development and the advantages which can be achieved by it will be explained in more detail in the following text with reference to the drawing, which represents only one possible embodiment approach.

BRIEF DESCRIPTION OF THE DRAWING FIGURES

Elements having the same effect are provided with the same reference symbols in all the figures. Only those elements which are required for direct understanding of the invention are illustrated and described.

DETAILED DESCRIPTION OF THE INVENTION

Figure 1:
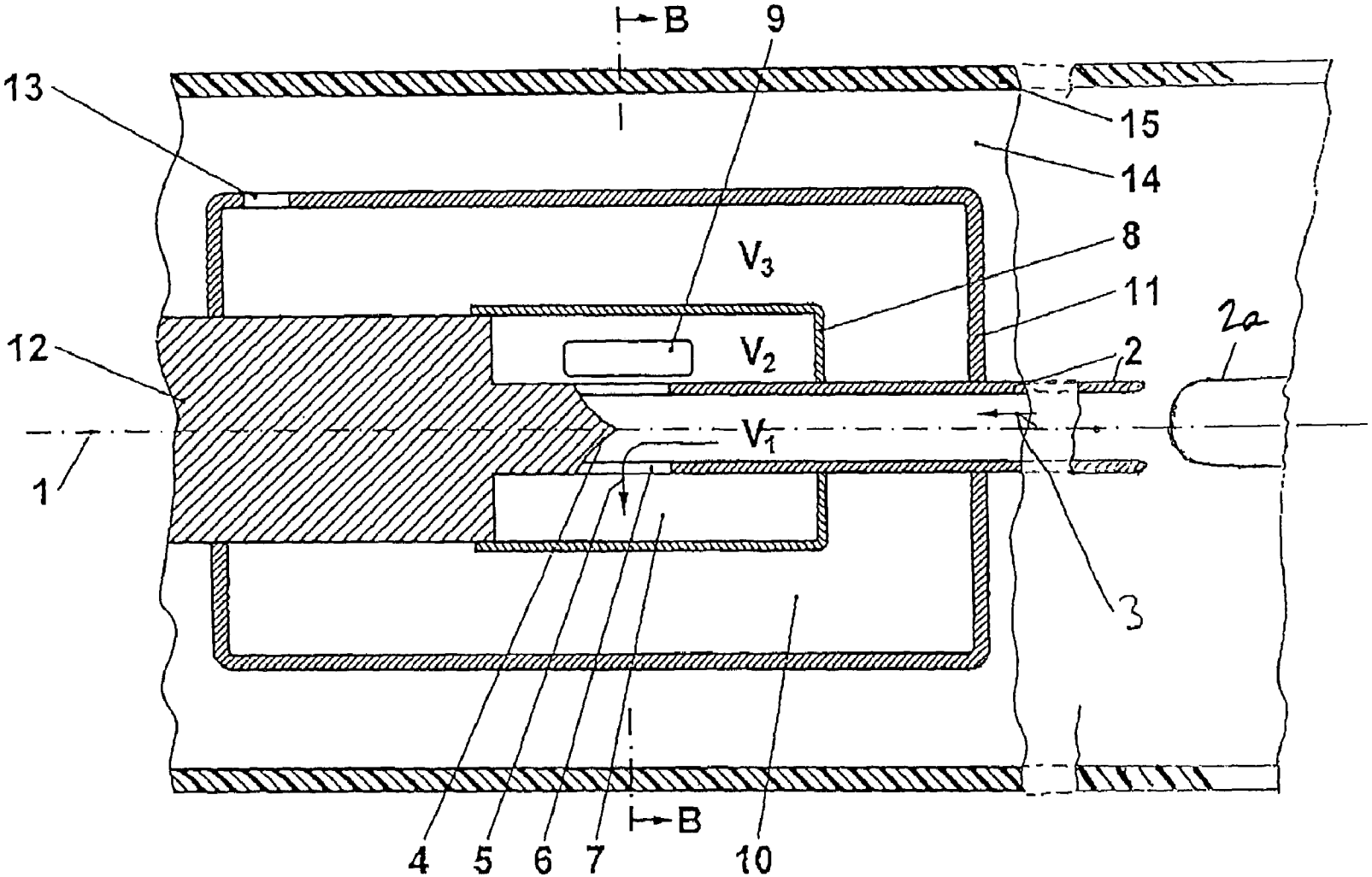
FIG. 1 shows a partial section, illustrated in highly simplified and schematic form, through the exhaust area of an arcing chamber of a first embodiment of a circuit-breaker.

A circuit-breaker may have one or more series-connected arcing chambers, which are filled with an isolating gas and operate on one of the conventional switching principles, that is to say by way of example in the form of a self-blasting chamber, a self-blasting chamber with at least one additional compression piston arrangement, or a simple compression piston switch. The circuit-breaker may, for example, have an arrangement of the power contacts similar to that disclosed in the document EP 0 836 209 A2, although it is also possible for one or both power contacts to be designed such that it or they can move. The circuit-breaker may, for example, be in the form of an outdoor switch, a part of a metal-encapsulated, gas-isolated switchgear assembly or a dead tank breaker. FIG. 1 shows a partial section, illustrated in a highly simplified and schematic form, through the exhaust area of an arcing chamber of a first embodiment of a circuit-breaker.

This first embodiment of the arcing chamber is rotationally symmetrical and extends along a longitudinal axis 1. The arcing chamber has an arc area, which is not illustrated here but in which an arc burns between two power contacts during the disconnection process. The arc heats the isolating gas in the arc area in a known manner. Some of this heated, pressurized gas flows out of the arc area through one of the power contacts, which is in the form of a tubular hollow contact 2. FIG. 1 shows a second power contact 2*a* arranged opposite the hollow contact 2. An arrow 3 indicates the flow direction of this hot gas from the arc area into the exhaust region. The hollow contact 2 has a volume $V_1$ in its interior. The gas flow indicated by the arrow 3 is deflected by an approximately conical deflection device 4, as indicated by an arrow 5, into a predominantly radial direction. The gas flow passes through openings 6, which are provided in the outer wall of the hollow contact 2, into an intermediate volume 7, which in this case is arranged concentrically with respect to the hollow contact 2 and has a volume $V_2$. The openings 6 in the outer wall of the hollow contact have a common cross section $A_1$. The gases are swirled in the intermediate volume 7.

Figure 3:
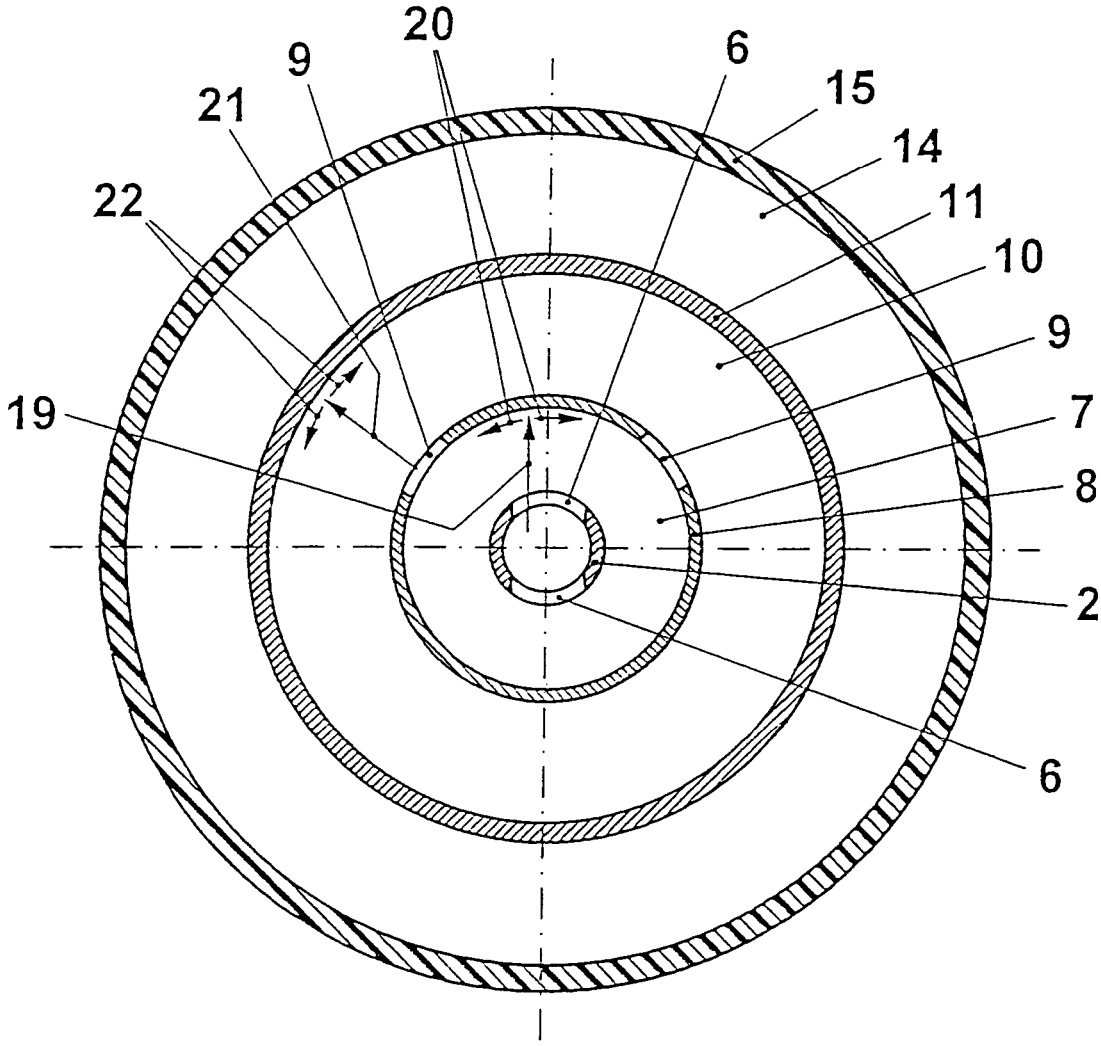
FIG. 3 shows a section B—B, at right angles to a longitudinal axis, through the first embodiment of a circuit-breaker as shown in FIG. 1.

The intermediate volume 7 is enclosed by a wall 8, which is preferably made of metal, for example steel or copper, although it may also be composed of a comparatively highly thermally conductive plastic. A plastic would be particularly advantageous at this point which, in addition to having good thermally conductive characteristics, would have the characteristic of vaporizing slightly in the presence of the hot gases, thus extracting thermal energy from the gases. A further advantage would be for the vaporized plastic to contain dissociating and/or electrically negative gases. The wall 8 has at least one opening 9 which allows the swirled gases to pass through in the radial direction into a concentrically arranged exhaust volume 10. The at least one opening 9 in the wall 8 has a cross section $A_2$. The openings 6 and 9 are generally offset with respect to one another, as can be seen in FIG. 3, so that the swirled gases flowing in the radial direction cannot flow further directly through the openings 9 into the exhaust volume 10. However, it is also feasible for one of the openings 9 to be provided such that it is entirely or partially coincident with one of the openings 6, in order to deliberately ensure a direct partial or complete flow through the opening 6 into the exhaust volume 10. The shape, size, arrangement and number of the openings 9 are optimally configured, and are matched to the respectively operational requirements.

The exhaust volume 10 is bounded on the outside by a metallic wall 11, which is supported firstly on the hollow contact 2 and secondly on a metallic connecting piece 12, which is connected to the electrical connection of the arcing chamber. The deflection device 4 is a part of this connecting piece 12. The exhaust volume 10 has a volume $V_3$. At least one opening 13, which has a cross section $A_3$, leads from the exhaust volume 10 into an arcing chamber volume 14, which is filled with cold gas. The at least one opening 13 is arranged axially offset with respect to the at least one opening 9. If, by way of example, the arcing chamber is intended to be used for outdoor installation, the arcing chamber volume 14 is closed in a pressuretight manner on the outside by means of an arcing chamber isolator 15.

The hollow contact 2 is generally moved to the left, in the direction of the arrow 3, together with the connecting piece 12 during disconnection of the circuit-breaker. The intermediate volume 7 and the exhaust volume 10 are arranged in a stationary manner in the interior of the arcing chamber isolator 15. By way of example, FIG. 1 shows the hollow contact 2 in the disconnected position. However, it is perfectly possible for the intermediate volume 7 to form a common assembly with the hollow contact 2 and the connecting piece 12 so that, during disconnection, the intermediate volume 7 is moved together with the hollow contact 2 through the exhaust volume 10, which is arranged such that it is stationary. It is also possible for the exhaust volume 10 to be combined with the intermediate volume 7, the hollow contact 2 and the connecting piece 12 to form a common assembly, which is moved as an entity to the left through the arcing chamber volume 14 during disconnection.

In this first embodiment of the arcing chamber, the gas flow (whose energy is somewhat reduced before the deflection device 4 due to the length of the hollow contact 2) has its energy increased somewhat once again due to the deflection in the radial direction and the swirling in the intermediate volume 7. In FIG. 3, an arrow 19 indicates the gas flow and its impact on the wall 8 of the intermediate volume 7. Two small arrows 20, which lead away from the impact point, indicate the swirling of the gas flow. This impact and the swirling which follows it result in particularly good heat transfer to the wall 8, thus advantageously reducing the volume of the swirling gas. When disconnecting short-circuits, a pressure difference in the range from about 0.4 to 1 bar is generally formed between the pressure in the end part of the hollow contact 2 and the pressure in the intermediate volume 7, with the pressure in the intermediate volume 7 being the greater. After remaining for a comparatively short time in the intermediate volume 7, the gas (which is still fairly hot) flows through the at least one opening 9 into the exhaust volume 10.

This outward flow takes place in the radial direction. The gas jet which is produced in this way strikes the wall (which is in this case in the form of a metallic wall 11) of the exhaust volume 10, by which it is deflected, resulting in intensive swirling. In FIG. 3, an arrow 21 indicates the gas flow and its impact on the wall 11 of the exhaust volume 10. Two small arrows 22 which lead away from the impact point indicate the swirling of the gas jet. This swirling results in particularly good heat transfer to the wall 11, so that the volume of the swirling gas is advantageously reduced. The somewhat cooled gas now flows to the axially offset opening 13 in the wall 11. This flow passes in a spiral shape around the longitudinal axis 1, with further heat being extracted from the gas. The cooled gas then flows out of this opening 13 into the arcing chamber volume 14, and is then available for further switching processes.

The flowing hot gas is cooled particularly well if, in this first embodiment of the circuit-breaker, the following ratios are complied with:

$$V_1/A_1=(0.1 \text{ to } 0.5)\text{m}$$

$$V_2/A_2=(0.1 \text{ to } 0.5)\text{m}$$

$$V_3/A_3=(1.0 \text{ to } 2.5)\text{m}.$$

In this case, by way of example, the volumes $V_{1,2,3}$ are measured in cubic meters, and the cross sections $A_{1,2,3}$ are measured in square meters.

A particularly good improvement in the performance of a first embodiment of a circuit-breaker was achieved by the following refinement of the exhaust area:

The volume $V_1$ within the hollow contact 2 was designed to be 0.33 liters, with the cross section $A_1$ of the first opening being 1,850 square millimeters. The volume $V_2$ of the intermediate volume 7 was designed to be 0.7 liters, with the cross section $A_2$ of the third opening 9 being 3,800 square millimeters. The volume $V_3$ of the exhaust volume 10 was designed to be 8 liters, with the cross section $A_3$ of the second opening 13 being 4,000 square millimeters.

Figure 2:
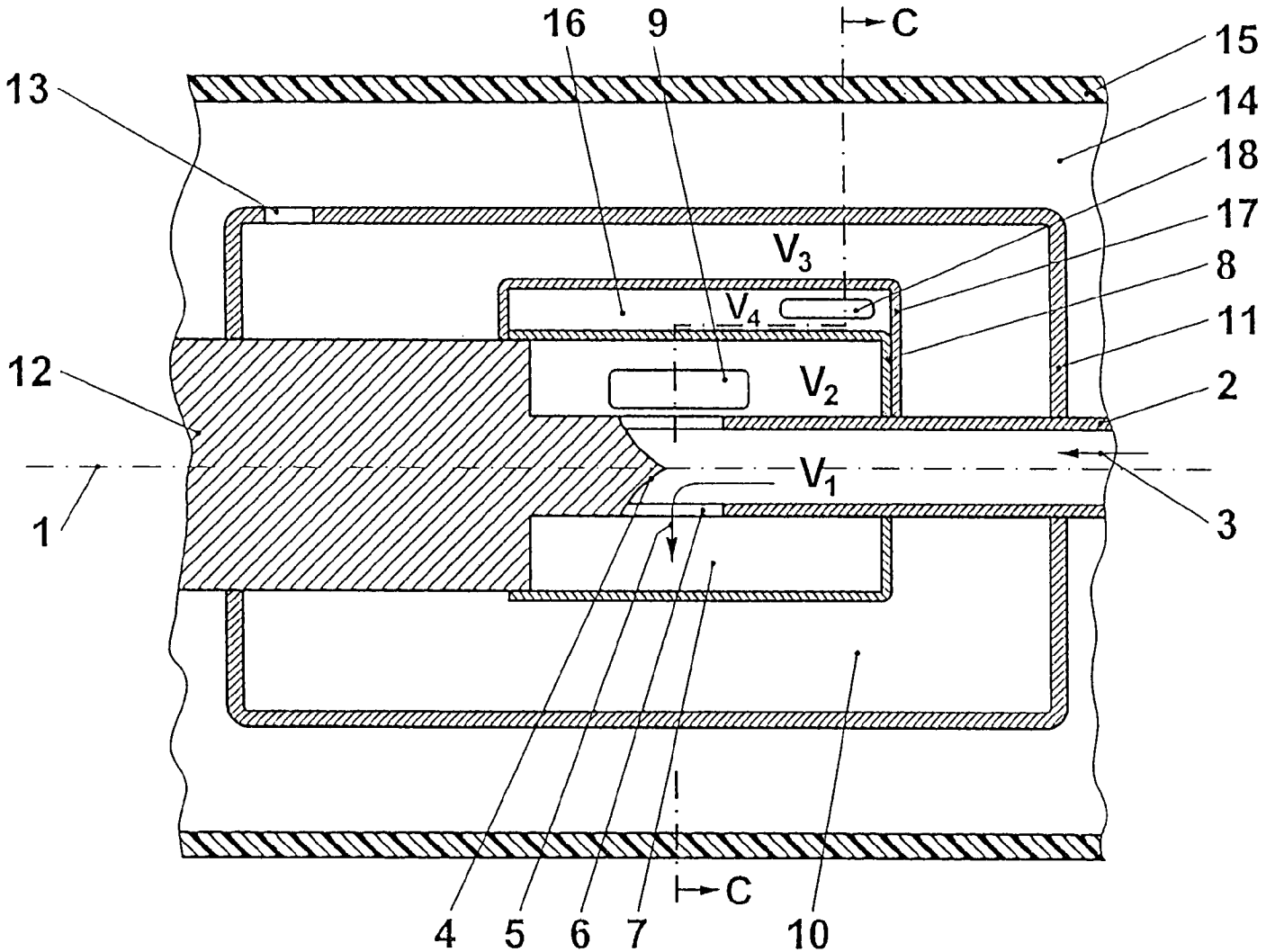
FIG. 2 shows a partial section, illustrated in highly simplified and schematic form, through the exhaust area of an arcing chamber of a second embodiment of a circuit-breaker.

FIG. 2 shows a partial section, illustrated in highly simplified and schematic form, through the exhaust area of an arcing chamber of a second embodiment of a circuit-breaker. This second embodiment of the arcing chamber is likewise generally rotationally symmetrical, and essentially corresponds to the first embodiment. However, in this case, a second additional volume 16 is provided, and has a volume $V_4$. The additional volume 16 is bounded by a wall 17, and concentrically surrounds the intermediate volume 7. The opening 9 in the wall 8 of the intermediate volume 7 opens into this additional volume 16. The wall 17 is preferably made of metal, for example steel or copper, but, however, may also be composed of a highly thermally conductive plastic, as has already been described further above. The wall 17 has at least one opening 18, which allows the swirled gases to pass through in the radial direction into the concentrically arranged exhaust volume 10. This at least one opening 18 in the wall 17 has a cross section $A_4$. This opening 18 may likewise be provided with a shutter-like cover, as has been described in conjunction with the opening 9. As can be seen from FIGS. 2 and 4, the openings 9 and 18 are generally offset axially with respect to one another, so that the swirled gases flowing in the radial direction cannot flow further directly through the openings 18 into the exhaust volume 10. However, it is also feasible for the openings 9 and 18 to at least partially overlap.

The additional volume 16 is shown only in the upper half of the drawing in FIG. 2. As illustrated in FIG. 2, it may extend around only a part of the circumference of the intermediate volume 7 or, as shown in FIG. 4, it may concentrically enclose the entire intermediate volume 7.

In this embodiment as well, the hollow contact 2 is generally moved to the left in the direction of the arrow 3 together with the connecting piece 12 during disconnection of the circuit-breaker. The intermediate volume 7, the additional volume 16 and the exhaust volume 10 are arranged such that they are stationary in the interior of the arcing chamber isolator 15. By way of example, FIG. 2 shows the hollow contact 2 in the disconnected position. However, it is perfectly possible for the intermediate volume 7 and the additional volume 16 to form a common assembly together with the hollow contact 2 and the connecting piece 12 so that, during disconnection, the intermediate volume 7 and the additional volume 16 are moved together with the hollow contact 2 through the exhaust volume 10, which is arranged such that it is stationary. It is also possible for the exhaust volume 10 to be combined with the intermediate volume 7 and the additional volume 16, the hollow contact 2 and the connecting piece 12 to form a common assembly, which is moved to the left as an entity through the arcing chamber volume 14 during disconnection.

Figure 4:
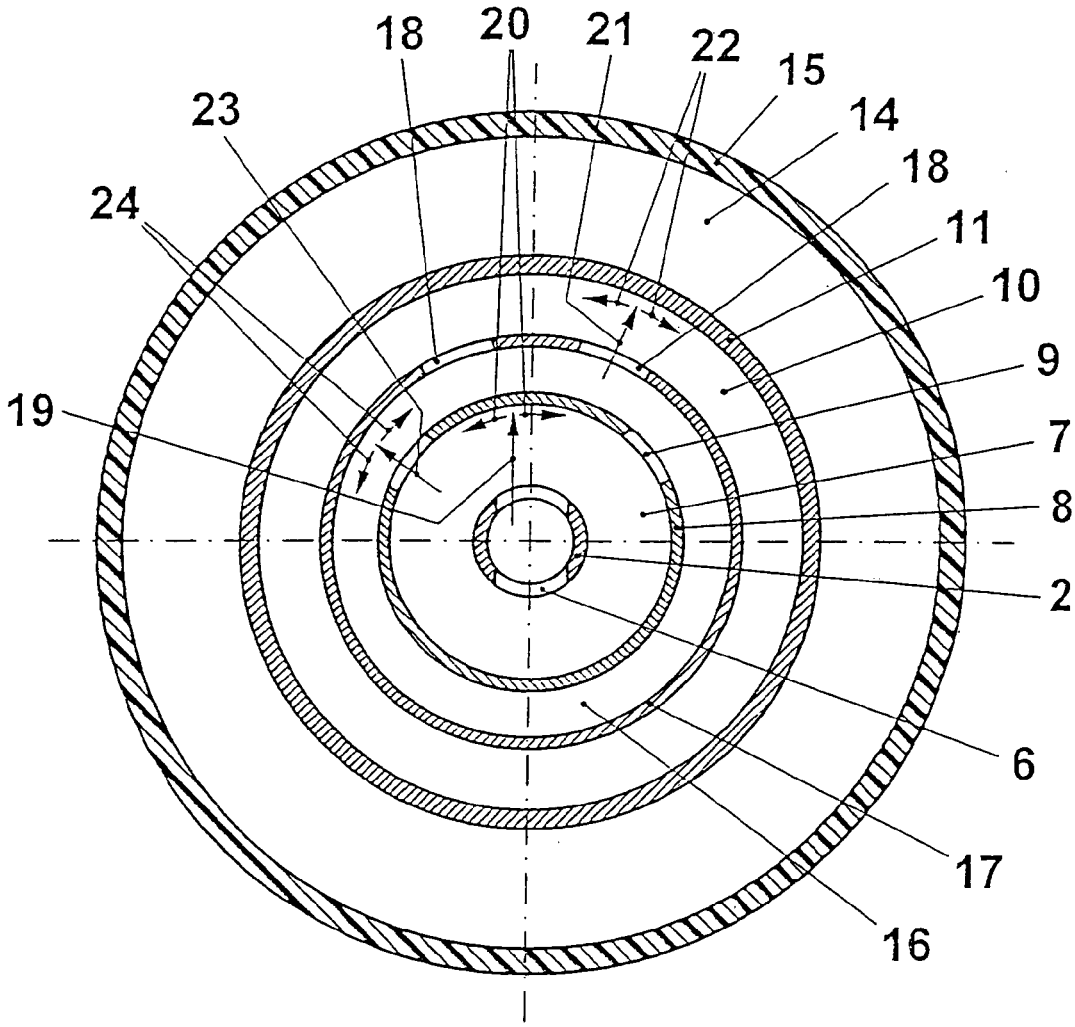
FIG. 4 shows a stepped section C—C, at right angles to a longitudinal axis, through the second embodiment of the circuit-breaker as shown in FIG. 2.

In FIG. 4, an arrow 23 indicates the gas flow out of the intermediate volume 7 and its impact on the wall 17 of the additional volume 16. Two small arrows 24 which lead away from the impact point indicate the swirling of the gas jet. This intensive swirling results in particularly good heat transfer to the wall 17, thus advantageously reducing the volume of the swirling gas. The swirled gas then flows out of the additional volume 16 through the openings 18 into the exhaust volume 10, as indicated by the arrow 21. The gas jet then once again impacts here, associated with intensive swirling, as already described. In this second embodiment variant of the circuit-breaker, the hot gas is cooled particularly well, since a further impact of the gas on the additional wall 17 and, associated with this, an even better cooling effect than in the first embodiment variant, are provided.

The method of operation of the second embodiment corresponds essentially to that of the first embodiment, but in this case with the gas jet which flows out of the intermediate volume 7 in the radial direction striking the wall 17 of the additional volume 16 and being deflected by it, resulting in intensive swirling. This swirling results in particularly good heat transfer to the wall 17, so that the volume of the swirling gas is advantageously once again reduced. After remaining for a comparatively short time in the additional volume 16, the gas flows through the at least one opening 18 into the exhaust volume 10. This outward flow takes place in the radial direction. The gas jet which is produced in this way strikes the wall 11 of the exhaust volume 10, and is deflected by it, resulting in intensive swirling. As already described, this swirling results in particularly good heat transfer to the wall 11, so that the volume of the swirling gas is advantageously once again reduced. The cooled gas now flows to the axially offset opening 13 in the wall 11. This flow takes place in a spiral shape around the longitudinal axis 1 within the exhaust volume 10, with further heat being extracted from the gas. The cooled gas flows out of this opening 13 into the arcing chamber volume 14, and is then available for further switching processes.

The flowing hot gas is cooled particularly well if, in this second embodiment, the following ratios are complied with:

$$V_1/A_1=(0.1 \text{ to } 0.5)\text{m}$$

$$V_2/A_2=(0.1 \text{ to } 0.5)\text{m}$$

$$V_3/A_3=(1.0 \text{ to } 2.5)\text{m, and}$$

$$V_3/A_3 \geqq V_4/A_4 \geqq V_2/A_2.$$

In this case, by way of example, the volumes $V_{1,2,3,4}$ are measured in cubic meters, and the cross sections $A_{1,2,3,4}$ in square meters.

Figure 5:
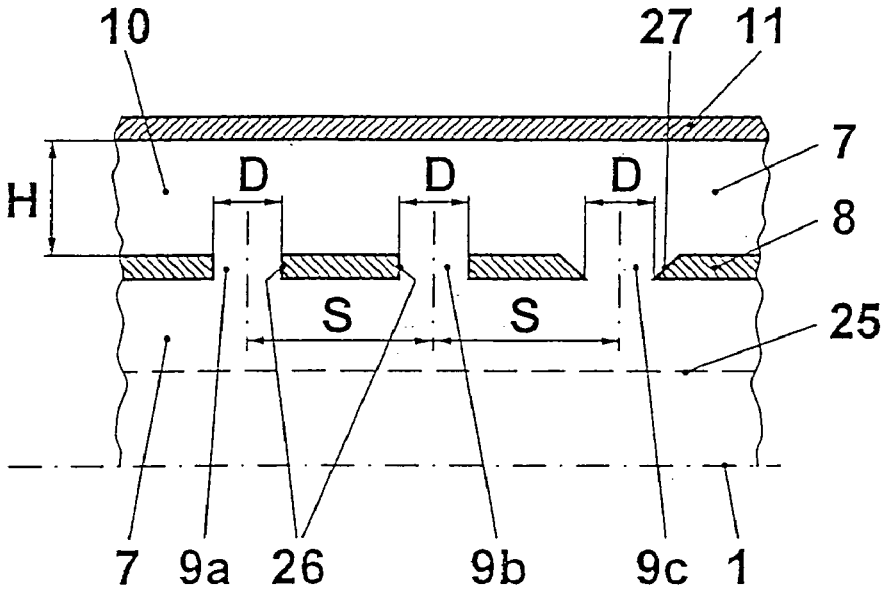
FIG. 5 shows a partial section, illustrated in highly simplified and schematic form, through the exhaust area of an arcing chamber of a third embodiment of a circuit-breaker.

FIG. 5 shows a partial section, illustrated in highly simplified and schematic form, through the exhaust area of an arcing chamber of a third embodiment of a circuit-breaker. This third embodiment of the arcing chamber is likewise rotationally symmetrical with respect to the longitudinal axis 1, and essentially corresponds to the first embodiment. The dashed-dotted line 25 indicates the external contour of the hollow contact 2, with the openings between the interior of the hollow contact 2 and the intermediate volume 7 not being shown. This third embodiment differs from the first embodiment in the formation of the opening 9. In this case, by way of example, provision is made for the openings 9 to be closed by means of a shutter which is in the form of a perforated plate and is provided with a large number of openings 9*a*, 9*b*, etc., in order in this way to produce a large number of radially directed gas jets. These gas jets then strike the wall 11 and are swirled at a large number of impact points, so that the hot gas is cooled particularly intensively there, and the volume of the gas is reduced particularly effectively, as a consequence of this.

Figure 6:
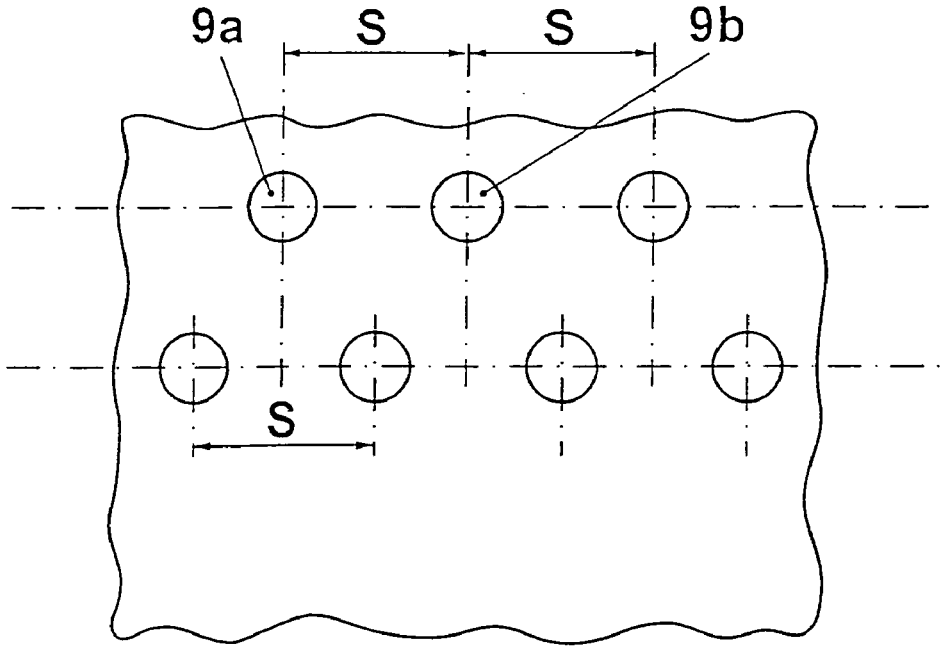
FIG. 6 shows a schematically illustrated detail of the third embodiment of the circuit-breaker.

The cross section $A_2$ of the opening 9 in the first embodiment is in this case shared between a large number of circular holes 9*a*, 9*b*, etc. Other refinements of the openings in the shutter, which is in the form of a perforated plate, are, of course, also feasible. In this case, as can be seen from FIGS. 5 and 6, the holes 9*a*, 9*b*, etc. have the same diameter D. However, it is also possible to provide different diameters D for the individual holes 9*a*, 9*b*, etc. The distance between the centers of the holes 9*a*, 9*b*, etc. in the axial direction is in this case, by way of example, S. However, it is also possible to provide different distances S between centers. The holes 9*a*, 9*b*, etc. are generally cylindrical and have cylindrical side walls 26. A distance H is provided between the outer face of the wall 8 of the intermediate volume 7 and the inner face of the opposite wall 11 of the exhaust volume 10. The critical factor for the efficiency of the cooling of the hot gas flowing through the holes 9*a*, 9*b*, etc. is the ratio H/D. For circuit-breakers such as these, a value of H/D in the range from 5 to about 1.5 is normally desirable. A value of H/D=2 has been found to be particularly advantageous.

The following relationship has been found to be particularly advantageous for dimensioning the axial distance S between the centers of the holes 9*a*, 9*b*, etc.

with the standard diameter D:

$$S=1.4\times H.$$

The distance between the centers of the holes 9*a*, 9*b*, etc. and a further row of holes, which are shifted on the circumference, is defined such that the impact points of the gas jets flowing through the holes on the respectively opposite wall are separated by the optimum distance S for the respective arrangement. If this distance S is not undershot, then this ensures that the swirls which are formed around the impact points do not interfere with one another in a negative manner, thus ensuring that the gases are cooled effectively in all cases.

If the disconnection rating of the circuit-breaker is intended to be increased further, then the shape, size, arrangement and number of the holes 9*a*, 9*b*, etc. may also be configured optimally, and matched to the respective operational requirements. Particularly good cooling performance is achieved if, as illustrated for the hole 9*c* in FIG. 5, the side wall 27 is inclined, with the hole 9*c* widening in the flow direction of the hot gases. An inclination with an angle of less than 45° with respect to the center axis of the respective hole has been found to be particular effective in this case.

This design, according to the described third embodiment, can also be used for modification of the second embodiment of the circuit-breaker and, to be precise, in this case both the wall 8 and the wall 17 together with their physical environment may be configured in a corresponding manner with holes. However, it is also possible to configure only one of the two walls 8 or 17 in a corresponding manner.

The embodiment variants described here so far are in principle rotationally symmetrical. If the available space conditions make this necessary, however, it is also possible without any problems to use a configuration which is not rotationally symmetrical and, by way of example in the case of the first embodiment variant, to design the intermediate volume 7 as a separate assembly, which is arranged entirely or partially other than in a rotationally symmetrical manner. By way of example, in the second embodiment variant of the circuit-breaker, the additional volume 16 may be in the form of a separate assembly, located entirely or partially away from the rotational symmetry. However, in the case of this second embodiment variant, it is also possible for both the intermediate volume 7 and the additional volume 16 to be in the form of separate assemblies, which are not rotationally symmetrical. However, with all these variants, care should be taken to ensure that the ratios described further above between the individual volumes $V_{1,2,3,4}$ and the cross sections $A_{1,2,3,4}$ of the openings 6, 9 and 18 between the corresponding volumes are complied with.

The cross sections of the openings 6, 9 and 18 between the corresponding volumes may be designed in very different ways. Only a small number of exemplary embodiments are quoted here. The arrangement of these openings likewise allows a large number of variants. If, for example, the arcing chamber is operated horizontally, then the majority of these openings may be arranged in the upper part of the exhaust area in order to ensure that solid switching residues are deposited in the lower part of the respective volume, where they cause no damage.

The embodiment variants of the circuit-breaker described so far each have only one power contact piece per arcing chamber, which is in the form of a tubular hollow contact 2. If it is intended to achieve a further increase in the power of the circuit-breaker, then the geometrical configuration of the exhaust region of the second power contact piece, which is opposite the first hollow contact 2, is also designed in a similar way to that in the already described embodiments so that a radial deflection device with a similar effect and at least one intermediate volume according to the invention may also be arranged in the path of the hot gases which are carried away on the face of the second power contact piece from the arc area in the direction of the exhaust volume 10. If the geometric relationships mentioned above are also observed on this side, then similarly effective cooling of the hot gases and, associated with this, a further advantageous reduction in the gas volume are also obtained here. A circuit-breaker whose arcing chamber or arcing chambers is or are provided with this improved guidance and cooling for the hot gases on both sides has a considerably greater disconnection rating than a conventional circuit-breaker with the same dimensions.

In the case of conventional circuit-breakers which are already in use in switchgear assemblies, it is possible to retrospectively install an additional intermediate volume in the exhaust area, in the outlet flow of the hot gases into the exhaust volume, during maintenance work, provided that the geometric configuration allows this with a reasonable level of effort. This allows the disconnection rating to be increased with comparatively little effort. The increased power switching capability of circuit-breakers modified in this way allows the transmission power of an existing high-voltage network to be increased with advantageously little effort, since no investment is required for new circuit-breakers. Since the vast majority of conventional arcing chambers are radially symmetrical, such retrofitting, or such retrospective upgrading of a circuit-breaker may be comparatively simple, and may advantageously be possible at an acceptable cost.

LIST OF REFERENCE SYMBOLS

1 Longitudinal axis
2 Hollow contact
3 Arrow
4 Deflection device
5 Arrow
6 Openings
7 Intermediate volume
8 Wall
9 Opening
9*a*, 9*b*, etc. Holes
10 Exhaust volume
11 Wall
12 Connecting piece
13 Opening
14 Arcing chamber volume
15 Arcing chamber isolator
16 Additional volume
17 Wall
18 Opening
19–24 Arrows
25 Dashed-dotted line
26,27 Side wall
$V_{1,2,3,4}$ Volumes
$A_{1,2,3,4}$ Cross sections
H Distance
S Distance between centers
D Diameter

What is claimed is:

1. A method for cooling exhaust gases in a circuit-breaker, the circuit-breaker having at least two power contact pieces, and at least one arcing chamber, that is filled with an isolating gas, extends along a longitudinal axis, and contains an arc area, the method comprising:

heating the isolating gas in the arc area in which an arc burns between the at least two power contact pieces during a disconnection process, wherein at least one of the at least two power contact pieces is configured as a tubular hollow contact; and dissipating hot gas from the arc area into an exhaust volume, through at least one intermediate volume between the hollow contact and the exhaust volume, the hot gas passing through at least one opening in a wall of the hollow contact into the at least one intermediate volume that is enclosed by a wall, such that a gas jet is produced that impacts on the wall, the impact resulting in swirling gas which induces heat transfer to the wall, thus reducing a volume of the swirling gas, wherein a pressure in the intermediate volume exceeds a pressure in an end part of the hollow contact.

2. The method as claimed in claim 1, wherein, when disconnecting short-circuits, a pressure difference in the range from 0.4 to 1 bar is formed between the pressure in the end part of the hollow contact and the pressure in the intermediate volume.

3. The method as claimed in claim 1, wherein some of the heated, pressurized gas flows out of the arc area and is deflected by a deflection device into a radial direction and is passed through radially aligned openings in the hollow contact and in the at least one intermediate volume.

4. The method as claimed in claim 3, wherein the openings are offset with respect to one another so that the swirled gases flowing in the radial direction cannot flow further directly through the openings into the exhaust volume.

5. The method as claimed in claim 3, the at least one opening being closed by means of a shutter which is in the form of a perforated plate and is provided with a large number of holes in order in this way to produce a large number of radially directed gas jets that then strike the wall and are swirled at a large number of impact points so that the hot gas is cooled particularly intensively there and the volume of the gas is reduced particularly effectively.

6. The method as claimed in claim 5, wherein a distance H is provided between the outer face of the wall and the inner face of the wall opposite it, wherein the holes each have a diameter D, and the ratio H/D is chosen in the range from 5 to 1.5.

7. The method as claimed in claim 5, wherein an axial distance between the centers of the holes and of a further row of holes, which are shifted on the circumference, is defined such that the impact points of the gas jets flowing through the holes on the respectively opposite wall are separated by an optimum distance S which ensures, if it is not undershot, that the swirls which are formed around the impact points do not interfere with one another in a negative manner, thus enabling that the gases are cooled effectively in all cases.

8. The method as claimed in claim 5, wherein an axial distance S is provided between the centers of the holes and obeys the relationship S=1.4*H, with H being a distance between the outer face of the wall and the inner face of the wall opposite it.

9. The method as claimed in claim 3, wherein the circuit breaker includes two sides, each side including one of the at least two power contacts configured as a tubular hollow contact, wherein an exhaust region of a second one of the at least two power contact pieces, which is opposite the first hollow contact, includes a radial deflection device and at least one intermediate volume that are arranged in the path of hot gases in order to provide an improved guidance and cooling for the hot gases on both sides and to increase the disconnection rating of the circuit breaker.

10. The method as claimed in claim 1, comprising:

dissipating cooled gas through an opening, that is arranged in a wall between the exhaust volume and the arcing chamber and is axially offset with respect to the opening, that is provided in the wall connecting the at least one intermediate volume to the exhaust volume, wherein the cooled gas flows in a spiral shape around the longitudinal axis within the exhaust volume, with further heat being extracted from the gas.

11. A circuit breaker, comprising:

at least two power contact pieces, wherein at least one of the at least two power contact pieces is configured as a tubular hollow contact;

at least one arcing chamber, that is filled with an isolating gas, extends along a longitudinal axis, and contains an arc area, in which an arc burns between the at least two power contact pieces during a disconnection process and heats the isolating gas in the arc area; and at least one intermediate volume between the hollow contact and an exhaust volume, wherein a pressure in the at least one intermediate volume exceeds a pressure in an end part of the hollow contact, wherein hot gas flows from the arc area into the exhaust volume through the at least one intermediate volume, the hot gas passing through at least one opening in a wall of the hollow contact into the at least one intermediate volume that is enclosed by a wall, such that a gas jet is produced that impacts on the wall, the impact resulting in swirling gas which induces heat transfer to the wall, thus reducing a volume of the swirling gas.

12. The circuit breaker as claimed in claim 11, wherein, when disconnecting short-circuits, a pressure difference in the range from 0.4 to 1 bar is generally formed between the pressure in the end part of the hollow contact and the pressure in the intermediate volume.

13. The circuit breaker as claimed in claim 11, comprising:

a deflection device, which is arranged on a side of the hollow contact facing away from the arc area and interacts with at least one first opening in the hollow contact for radial deflection of the hot gases into the exhaust volume; and radially aligned openings in the hollow contact and in the at least one intermediate volume for passing some of the heated, pressurized gas.

14. The circuit breaker as claimed in claim 13, wherein the openings are offset with respect to one another so that the swirled gases flowing in a radial direction cannot flow further directly through the openings into the exhaust volume.

15. The circuit breaker as claimed in claim 13, the at least one opening being closed by means of a shutter which is in the form of a perforated plate and is provided with a large number of holes in order in this way to produce a large number of radially directed gas jets that then strike the wall and are swirled at a large number of impact points.

16. The circuit breaker as claimed in claim 15, wherein a distance H is provided between the outer face of the wall and the inner face of the wall opposite it, wherein the holes each have a diameter D, and the ratio H/D is chosen in the range from 5 to 1.5.

17. The circuit breaker as claimed in claim 15, wherein an axial distance between the centers of the holes is defined such that the impact points of the gas jets flowing through the holes on the respectively opposite wall are separated by the optimum distance S which ensures, if it is not undershot, that the swirls which are formed around the impact points do not interfere with one another in a negative manner, and in particular that further holes, which are shifted at the circumference with respect to the holes, are arranged such that the impact points of the gas jets flowing through the holes on the opposite wall are separated by the distance S all round.

18. The circuit breaker as claimed in claim 15, wherein an axial distance S is provided between the centers of the holes and obeys the relationship S=1.4*H, with H being a distance provided between the outer face of the wall and the inner face of the wall opposite it.

19. The circuit breaker as claimed in claim 15, wherein the holes have inclined side walls, such that the holes widen in the flow direction of the hot gas, in particular that the side walls of the widening holes are at an angle in the range from 35° to 50°, but are preferably at an angle of 45 °,with respect to the longitudinal axis of the holes.

20. The circuit breaker as claimed in claim 13, wherein a first intermediate volume is provided between the hollow contact and the exhaust volume and is bounded from the exhaust volume by a first wall, with the first wall having at least one third, radially aligned opening, which connects the first intermediate volume to the exhaust volume.

21. The circuit breaker as claimed in claim 20, wherein the exhaust volume is connected through at least one second opening to the arcing chamber volume and the second opening is arranged axially offset with respect to the at least one third opening, that is provided in the first wall connecting the intermediate volume to the exhaust volume, such that the gas flows in a spiral shape around the longitudinal axis within the exhaust volume, for further heat extraction from the gas.

22. The circuit breaker as claimed in claim 13, wherein at least one second intermediate volume, which is referred to as an additional volume, is arranged between the first intermediate volume and the exhaust volume and is bounded from the exhaust volume by a second wall, with the second wall having at least one fourth, radially aligned opening, which connects the additional volume to the exhaust volume.

23. The circuit breaker as claimed in claim 13, wherein the at least one intermediate volume is arranged concentrically with respect to the hollow contact, or the at least one intermediate volume is arranged concentrically with respect to the deflection device, or the exhaust volume is arranged concentrically in the arcing chamber, or an additional volume encloses concentrically the entire at least one intermediate volume.

24. The circuit breaker as claimed in claim 13, wherein the at least one intermediate volume is arranged in a stationary fixed manner in the exhaust volume, or the at least one intermediate volume is firmly connected to the hollow contact and can move together with the hollow contact, or the at least one intermediate volume is firmly connected to the hollow contact and to the exhaust volume and can move together with the hollow contact and the exhaust volume.

25. The circuit breaker as claimed in claim 13, wherein the circuit breaker comprises two sides, each side including one of the at least two power contacts configured as a tubular hollow contact, wherein an exhaust region of a second one of the at least two power contact pieces, which is opposite the first hollow contact, includes a radial deflection device and at least one intermediate volume that are arranged in the path of hot gases in order to provide guidance and cooling for the hot gases on both sides and to increase a disconnection rating of the circuit breaker.

26. The circuit breaker as claimed in claim 11, wherein the exhaust volume is connected through at least one second opening to an arcing chamber volume and the second opening is arranged axially offset with respect to at least one third opening, that is provided in the first wall connecting the intermediate volume to the exhaust volume, such that the gas flows in a spiral shape around the longitudinal axis within the exhaust volume, for further heat extraction from the gas.

* * * * *